United States Patent [19]

Matsushima et al.

[11] 4,127,623

[45] Nov. 28, 1978

[54] PROCESS FOR PRODUCING POLYOLEFIN SHORT FIBERS

[75] Inventors: Shunsuke Matsushima, Ibaraki; Kiyoshi Kawai, Toyonaka, both of Japan

[73] Assignee: Sumitomo Chemical Company, Limited, Osaka, Japan

[21] Appl. No.: 743,419

[22] Filed: Nov. 19, 1976

Related U.S. Application Data

[63] Continuation of Ser. No. 598,638, Jul. 24, 1975, abandoned.

[30] Foreign Application Priority Data

Aug. 3, 1974 [JP] Japan ..... 49-89149

[51] Int. Cl.[2] ..... D21F 11/00

[52] U.S. Cl. ..... 264/13; 162/157 R; 264/140; 264/329; 528/502

[58] Field of Search ..... 264/13, 140, 204, 205, 264/329; 162/157 R; 528/502

[56] References Cited

U.S. PATENT DOCUMENTS

| | | | |
|---|---|---|---|
| 3,227,784 | 1/1966 | Blades et al. | 264/176 R |
| 3,740,383 | 6/1973 | Gabellieri et al. | 264/206 |
| 3,756,441 | 9/1973 | Anderson et al. | 264/205 |
| 3,883,630 | 5/1975 | Raganato | 264/102 |
| 3,885,014 | 5/1975 | Fukada et al. | 264/205 |
| 3,914,354 | 10/1975 | Ueki et al. | 264/13 |
| 3,976,631 | 8/1976 | Molen et al. | 264/205 |

*Primary Examiner*—Jay H. Woo

*Attorney, Agent, or Firm*—Stevens, Davis, Miller & Mosher

[57] ABSTRACT

A process for producing poly-α-olefin short fibers, which is characterized by further increasing the pressure of a solution system comprising a fiber-forming crystalline poly-α-olefin and a solvent and existing in the form of a solution mixture of two liquid phases at an elevated temperature and pressure, and immediately thereafter ejecting the solution system under pressure through a nozzle or orifice.

9 Claims, No Drawings

PROCESS FOR PRODUCING POLYOLEFIN SHORT FIBERS

This is a continuation of application Ser. No. 598,638 filed July 24, 1975, now abandoned.

This invention relates to a process for producing short-fibrous materials by ejecting a high-temperature solution of polyolefins in a solvent.

Fibrous polyolefins have been known to be useful as synthetic pulps, nonwoven fabrics, and the like. As has been disclosed in Japanese Patent Publication No. 6,215/66, one of the processes for producing a fibrous polyolefin involves in ejecting the polymer solution at a high temperature and pressure into a low pressure zone to obtain a continuous fibrous material. This material may be effectively used as such when it is intended to be utilized in the form of a long fibrous material. On the other hand, however, when such a fibrous material which is highly fibrillated is intended to be utilized in the form of pulp, a series of additional steps such as cutting, beating, and the like, as well as corresponding equipment are necessary.

An object of this invention is to provide a process for economically producing short-fibrous materials from polyolefins, thereby to overcome the aforesaid disadvantage of the prior art.

Another object of this invention is to disclose necessary conditions for the polymer solution which enable the present process to be successful as well as to provide equipment suitable for carrying out the present process.

Other objects of this invention will become apparent from the following description.

According to the process of this invention, it is possible to obtain from polyolefins a finely fibrillated short-fibrous material, 0.1 mm to 20 cm in length and 1 $\mu$ to 0.5 mm in width or diameter. This material, as such or after having been slightly disintegrated, can be transported as an aqueous slurry of fibrous substance so that the material may be utilized in the form of pulp material.

This invention provides a process for producing polyolefin short fibers, which is characterized by further increasing the pressure of a solution system comprising a fiber-forming poly-$\alpha$-olefin, preferably linear polyethylene, and a solvent and existing already in the form of a solution mixture of two liquid phases at an elevated temperature and pressure, and immediately thereafter ejecting the solution system under pressure through a nozzle or orifice.

An explanation for the term "solution mixture of two liquid phases" as used herein is given below. When a mixture comprising a polymer having a certain molecular weight and a solvent is elevated in temperature in a closed system, the mixture becomes a homogeneous solution and on further elevation in temperature above the lower critical solution temperature (T*c*); the homogeneous solution becomes heterogeneous, separating into two phases, one containing the polymer in a higher concentration and the other in a lower concentration. T*c*is pressure-dependent and becomes higher as the pressure of the system is increased. T*c* of the systems involving various polymers and solvents can be determined experimentally.

In the present process, it is important that the polymer solution existing under the autogenous pressure is further increased in pressure at the time of ejection by a compressed gas or by mechanical means. It seems that by increase of pressure, the state of the polymer solution at a temperature above T*c* is shifted toward homogeneous because of the elevation of T*c* and such a change in the state of polymer solution is closely related to the short fiber formation. The ultimate pressure after increase of the pressure is selected so that the temperature of the solution is lower than the lower critical solution temperature (T*c*) under said ultimate pressure. For the essential feature of the invention, however, it makes no difference whether such a reasoning is correct or not.

The polyolefin to be used in the present process to form the polymer solution is a linear polyethylene, branched polyethylene, polypropylene, a copolymer of ethylene and a vinyl monomer (e.g. vinylacetate, maleic anhydride, etc.), polystyrene, or a mixture of two or more of these polyolefins.

The method of preparing the polymer solution is explained below.

The solvents for use include hydrocarbons generally used in olefin polymerization (paraffinic or napthenic hydrocarbons having 5, 6 or 7 carbon atoms), aromatic hydrocarbons, chloroparaffins (methylene chloride, etc.), and other solvents which dissolve polyolefins to form a polymer solution having a lower critical solution temperature. Mixtures of these solvents as well as such solvents containing a monomer such as ethylene, propylene, or the like may also be used.

The polyolefin solution for use in the present process can be prepared by dissolving a powdered or granulated polyolefin in the above-noted solvents, or by adjusting the concentration of a polymer solution obtained by solution polymerization of an olefin. When the polymer is obtained by so-called slurry polymerization, wherein the polymer is produced in the form of granule, it is most simple and economical to prepare the polyolefin solution by heating the resulting slurry. In heating the slurry, it is possible to add an additive such as an alcohol, water, or the like, to deactivate the polymerization catalyst; an antioxidant; a filler such as finely powdered calcium carbonate, zinc oxide, titanium oxide, or other inorganic fine powders; and a pigment such as carbon black. To adjust the polymer concentration, a solvent can be added prior to dissolution of the polymer. The whole or a part of the unreacted monomer after polymerization can remain in the final polymer solution. In such a case, vaporization of the monomer from the polymer solution being ejected will favorably affect the ejection.

Among these methods for preparing the polymer solution, a suitable one in view of the quality and the cost may be selected.

Although the optimum concentration of the polymer solution varies according to the polymer type, solution temperature, and ejection pressure, a suitable concentration is generally in the range from 2 to 30%, because a concentration below 2% is not advantageous in view of the increased cost for solvent recovery, while a concentration exceeding 30% is unfavorable for obtaining fibers of sufficient quality. A preferable concentration is in the range from 5 to 20%.

The temperature of the polymer solution before ejection is sufficiently high to ensure complete solution and generally in the range from 140° to 250° C., which are higher than the lower critical solutions temperature of the polymer solution being ejected. The solution mixture of two liquid phases at said elevated temperature is under autogenous pressure in the range of 5 to 25 kg/cm$^2$ (gage pressure). The pressure of the polymer solution to be ejected is elevated above its autogenous pressure at the above-noted temperature by increase of pressure by means of a compressed gas or a plunger pump to a gage pressure of 50 kg/cm$^2$ or higher, preferably 60 to 150 kg/cm$^2$. It is important for the precent process to carry out the increase in the pressure of the stirred polymer solution under autogenous pressure to the above-noted ultimate pressure immediately before ejection through a nozzle. The time elapsed from the completion of increase of pressure to the ejection is generally 1 minute or less, preferably 0.5 minute or less.

The dimension of the nozzle to be used is such that the inner diameter is 0.5 to 3.0 mm and the length is 5 to 40 mm. The temperature of the lower pressure zone is sufficiently low to precipitate the polymer from the ejected solution and generally in the range from room temperature to 100° C. In order to obtain a satifactory short-fibrous material, the pressure in the lower pressure zone is selected from the range from atmospheric pressure to 3 kg/cm$^2$. When short-fibrous material formed on ejection of the polymer solution is contacted with water containing a surface active agent, with stirring or without stirring, there is obtained a dispersion of said short-fibrous material in water, that is, a polyolefin pulp slurry. The stirrer blades, if used, are preferably provided with sharp cutting edges which may further cut the short-fibrous material more finely. The short-fibrous material thus obtained resembles a pulp, generally 0.5 to 15 mm in fiber length.

The invention is illustrated below with reference to Examples.

EXAMPLE 1

In a 1.5-liter autoclave, were charged 80 g of a low-pressure polyethylene (MI = 20) and 0.8-liter of commercial hexane to prepare a solution at 190° C. The gage pressure in the autoclave in this stage was 18 kg/cm$^2$. After rapidly elevating the gage pressure to 100 kg/cm$^2$ by introducing compressed nitrogen in the tank, the polymer solution, while being stirred at 300 rpm and maintaining said pressure, was immediately ejected under a nitrogen atmosphere through a nozzle, 1.8 mm in inner diameter and 30 mm in length. The fibrous material thus obtained was in the form of fine fibers, 0.1 to 3 cm in length. After drying, the fibrous material was treated in a stirred tank with water containing a surface active agent to form an aqueous slurry which showed a fluid flow.

COMPARATIVE EXAMPLE

In a 1.5-liter autoclave, were charged 80 g of a low-pressure polyethylene (MI = 20) and 0.8 liter of commercial hexane to prepare a polymer solution at 190° C. After the pressure in the tank had been elevated to 100 kg/cm$^2$ by introducing compressed nitrogen, the polymer solution was left for 3 minutes while being stirred and then ejected under the pressure maintained at 100 kg/cm$^2$ through a nozzle, 1.8 mm in inner diamter and 30 mm in length. The resulting fibrous material was a continuous one.

EXAMPLE 2

The same procedure as in Example 1 was repeated, except that 80 g of a low-pressure polyethylene (MI = 8) was used.

There was obtained a fibrous polymer having a length, 0.5 to 10 cm, longer than that obtained in Example 1.

EXAMPLE 3

The same procedure as in Example 1 was repeated, except that 60 g of a low-pressure polyethylene (MI = 20), 20 g of polystyrene (MI = 1.4), and 0.8 liter of commercial hexane were used.

There was obtained a fibrous polymer, 0.1 to 3 cm in length.

EXAMPLE 4

The same procedure as in Example 1 was followed, except that 60 g of a low-presure polyethylene (MI = 20), 20 g of polypropylene (MI = 8), and 0.8 liter of commercial hexane were used.

There was obtained a fibrous polymer having a length of 0.1 to 5 cm.

EXAMPLE 5

The same procedure as in Example 1 was followed, except that 40 g of a low-pressure polyethylene (MI = 20), 40 g of a high-pressure polyethylene (MI = 1.5) and 0.8 liter of commercial hexane were used. There was obtained a fibrous polymer having a length, 0.1 to 2 cm, shorter than that obtained in Example 1. A 2-gram portion was weighed out of the said fibrous material and disintegrated in 300 cc of water in the presence of C.M.C. (carboxymethylcellulose) used as dispersing agent by means of a commercial mixer to form easily a synthetic pulp.

EXAMPLE 6

The procedure of Example 1 was repeated, except that 80 g of a low-pressure polyethylene (MI = 20), 16 g of powdered calcium carbonate, 0.6 $\mu$ in average diameter, and 800 cc of commercial hexane were used. There was obtained in fibrous polymer material having a length of 0.05 to 1 cm.

EXAMPLE 7

The procedure of Example 1 was repeated, except that 80 g of a low-pressure polyethylene (MI = 20), 0.8 g of carbon black, a suitable amount of a dispersing agent for carbon black, and 0.8 liter of commercial hexane were used. There was obtained a fibrous material containing carbon black uniformly dispersed throughout the fiber.

EXAMPLE 8

In a 50-liter autoclave, were charged 3 kg of a low-pressure polyethylene (MI = 20) and 30 liters of commercial hexane to prepare a solution at 190° C. The resulting polymer solution was sent from the autoclave through a conduit to a plunger pump to elevate the pressure to 80 kg/cm$^2$ and ejected through a nozzle, 1.3 mm in inner diameter and 30 mm in length, into an ejection tank. The ejection tank was fed with hot water at 90° C., containing a surface active agent and stirrer blades with cutting edges were rotating at high speed in the water. The short-fibrous material formed on ejection was stripped of the solvent in the tank and could be withdrawn from the bottom part of the tank in the form of pulp slurry in hot water. This pulp-form material was blended with a natural pulp in fifty-fifty ratio and hand-formed into a web having a favorable smoothness without uneven formation. A sheet made of a mixture of synthetic pulp and wood pulp obtained by heat-treating the said web has a good dimensional stability, a high degree of whiteness, a high wet breaking length of 2 km, and a high dry breaking length of 3.6 km, indicating favorable physical properties of the paper.

What is claimed is:

1. A process for producing poly-α-olefin short fibers, which consists essentially of further increasing the pressure of a solution mixture of two liquid phases comprising a fiber-forming crystalline poly-α-olefin and a solvent selected from the group consisting of a paraffinic and naphthenic hydrocarbon, aromatic hydrocarbon, chloroparaffin, and a mixture thereof and having said poly-α-olefinconcentration of from 5 to 20%, at temperature of from 140° to 250° C. and higher than the lower critical solution temperature of said solution mixture under its autogenous pressure in the range of 5 to 25 kg/cm$^2$ (gage pressure), to 50 kg/cm$^2$ (gage pressure) or higher, and immediately thereafter ejecting the solution mixture under pressure through a nozzle or orifice to a low pressure zone, wherein the time elapsed between completion of the increase of the pressure and the ejection is 0.5 minute or less.

2. A process according to claim 1, wherein the concentration of the polyolefin solution is 5 to 20%.

3. A process according to claim 1, wherein the pressure of the solution mixture of two liquid phases immediately before ejection is 60 kg/cm$^2$ to 150 kg/cm$^2$ (gage pressure).

4. The process of claim 1 wherein the pressure in the low pressure zone is in the range of about atmospheric pressure to about 3 kg/cm$^2$.

5. The process of claim 1 wherein the nozzle in the low pressure zone has an inner diameter of about 0.5 to about 3.0 mm and a length of about 5 to about 40 mm.

6. A process according to claim 1, wherein the poly-α-olefin is linear polyethylene, branched polyethylene, polypropylene, a copolymer of ethylene and a vinyl monomer, polystyrene, or a mixture of two or more of these.

7. A process according to claim 1, wherein the poly-α-olefin is linear polyethylene.

8. A process according to claim 1, wherein the ejected fibers are dispersed in water containing a surface active agent with or without stirring.

9. A process according to claim 8, wherein the stirring is effected by means of stirrer blades with sharp edges.

* * * * *